US010660458B2

(12) United States Patent
Potdar et al.

(10) Patent No.: US 10,660,458 B2
(45) Date of Patent: May 26, 2020

(54) PAN CHILLER SYSTEM WITH LIQUID COOLANT

(71) Applicant: ILLINOIS TOOL WORKS INC., Glenview, IL (US)

(72) Inventors: Ashutosh A. Potdar, Fort Worth, TX (US); Rafael A. Castillo-Borelly, North Richland Hills, TX (US); Joseph F. Sanders, North Richland Hills, TX (US); Keith G. Thompson, Haslet, TX (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 226 days.

(21) Appl. No.: 15/861,145

(22) Filed: Jan. 3, 2018

(65) Prior Publication Data

US 2018/0184815 A1 Jul. 5, 2018

Related U.S. Application Data

(60) Provisional application No. 62/442,144, filed on Jan. 4, 2017.

(51) Int. Cl.

| | |
|---|---|
| ***A47F 3/04*** | (2006.01) |
| ***F25D 17/02*** | (2006.01) |
| ***F25D 23/06*** | (2006.01) |
| ***A47F 10/06*** | (2006.01) |

(52) U.S. Cl.

CPC ..... *A47F 3/0491* (2013.01); *A47F 3/0439* (2013.01); *A47F 10/06* (2013.01); *F25D 17/02* (2013.01); *F25D 23/061* (2013.01); *F25D 23/063* (2013.01); *F25D 2400/14* (2013.01)

(58) Field of Classification Search

CPC ..... A47F 3/0491; A47F 3/0439; A47F 10/06; F25D 23/061; F25D 23/063; F25D 2400/14; F25D 17/02

USPC ..... 62/257

See application file for complete search history.

(56) References Cited

U.S. PATENT DOCUMENTS

| | | | |
|---|---|---|---|
| 1,932,694 | A | 10/1933 | Gray |
| 1,968,812 | A | 8/1934 | Ackerman |
| 2,321,695 | A | 6/1943 | Miller |
| 2,346,430 | A | 4/1944 | Hauser |
| 2,667,761 | A | 2/1954 | Sellstrom |
| 2,877,000 | A | 3/1959 | Person |
| 3,952,794 | A | 4/1976 | Spanoudis |
| 4,280,335 | A | 7/1981 | Perez et al. |

(Continued)

FOREIGN PATENT DOCUMENTS

| | | |
|---|---|---|
| WO | WO-01/92129 A1 | 12/2001 |

*Primary Examiner* — Steve S Tanenbaum

(74) *Attorney, Agent, or Firm* — Thompson Hine LLP

(57) ABSTRACT

A pan chiller system includes a pan chiller unit having a food well, with a plurality of hollow divider rails arranged within the food well to define at least one opening to receive one or more food pans to be cooled, where the plurality of divider rails define a first rail flow path and a second rail flow path. A chilled liquid coolant system chills liquid coolant and moves the chilled liquid coolant into both the first rail flow path and the second rail flow path. A control arrangement is configured for controlling chilled liquid coolant flow such that a first temperature condition maintained in the first rail flow path is different than a second temperature condition maintained in the second rail flow path.

14 Claims, 7 Drawing Sheets

(56) References Cited

U.S. PATENT DOCUMENTS

| | | | | |
|---|---|---|---|---|
| 4,760,711 | A | 8/1988 | Kopatz et al. | |
| 4,856,579 | A | 8/1989 | Wolfe | |
| 5,117,649 | A | 6/1992 | Mangini et al. | |
| 5,168,712 | A | 12/1992 | Coelho et al. | |
| 5,355,687 | A | 10/1994 | Carpenter et al. | |
| 5,671,808 | A | 9/1997 | Kleyn | |
| 5,921,096 | A | 7/1999 | Warren | |
| 5,927,092 | A | 7/1999 | Kushen et al. | |
| 6,185,951 | B1 | 2/2001 | Lane et al. | |
| 6,253,668 | B1 | 7/2001 | Lee | |
| 6,313,990 | B1 | 11/2001 | Cheon | |
| 6,541,739 | B2 | 4/2003 | Shei et al. | |
| 6,963,488 | B1 | 11/2005 | Chen | |
| 2005/0047083 | A1 | 3/2005 | Kondo et al. | |
| 2005/0136160 | A1* | 6/2005 | Schwichtenberg | A47F 3/001 426/241 |
| 2005/0166631 | A1 | 8/2005 | Trujillo, Jr. et al. | |
| 2006/0053805 | A1 | 3/2006 | Flinner et al. | |
| 2006/0185374 | A1* | 8/2006 | Bansch | F04B 49/24 62/196.3 |
| 2009/0188275 | A1* | 7/2009 | Lintker | A47F 3/0439 62/446 |

* cited by examiner

PAN CHILLER SYSTEM WITH LIQUID COOLANT

CROSS-REFERENCES

This application claims the benefit of U.S. Provisional Application Ser. No. 62/442,144, filed Jan. 4, 2017, which is incorporated herein by reference.

TECHNICAL FIELD

This application relates generally to the food preparation industry and, more specifically, to a pan chiller system for providing cooling to food pans provided in a food well.

BACKGROUND

The present cooling system relates to the food industry, and more particularly, to a pan chiller system for providing uniform cooling to food pans provided in a food well.

In the food service industry, it is important to maintain food at desired temperatures in food pans to preserve food freshness. Accordingly, pan cooling/chilling systems have been developed, including that described in U.S. Pat. No. 9,068,773, which patent provides an improved chilling system utilizing a desirable rail design that flows chilled liquid coolant. However, in some instances the system of the '773 may overcool the lower portions of pans because the lower portions of pans tend to lose less heat to ambient environment.

It would be desirable to provide pan chiller system that enables better control of pan cooling, particularly as between upper and lower portions of the pans.

SUMMARY

In one aspect, a pan chiller system includes a food well with a plurality of hollow divider rails to define at least one opening to receive one or more food pans to be cooled. The divider rails include multiple rails defining a first rail flow path and multiple rails defining a second rail flow path. A chilled liquid coolant system is provided for chilling liquid coolant and for moving chilled liquid coolant to both the first rail flow path and the second rail flow path. A flow control arrangement is configured for controlling flow along at least one of the first rail flow path or the second rail flow path such that a first temperature condition maintained in the first rail flow path is different than a second temperature condition maintained in the second rail flow path.

In another aspect, a pan chiller system includes a pan chiller unit having a food well, where a plurality of hollow divider rails are arranged within the food well to define at least one opening to receive one or more food pans to be cooled, the plurality of divider rails defining a first rail flow path and a second rail flow path. A chilled liquid coolant system chills liquid coolant and moves the chilled liquid coolant into both the first rail flow path and the second rail flow path. A control arrangement is configured for controlling chilled liquid coolant flow such that a first temperature condition maintained in the first rail flow path is different than a second temperature condition maintained in the second rail flow path.

In a further aspect, a method for cooling food within food pans involves: providing an upper rail flow path along a food pan well and in heat exchange relationship with upper portions of multiple food pans; providing a second rail flow path along the food pan well and in heat exchange relationship with lower portions of the multiple food pans; utilizing a chilled a chilled liquid coolant system to chill a liquid coolant to a set temperature; delivering the liquid coolant to the upper rail flow path such that a first temperature condition is maintained along the upper rail flow path; and delivering the liquid coolant to the lower rail flow path such that a second temperature condition is maintained along the lower rail flow path, wherein the second temperature condition is a higher temperature condition than the first temperature condition.

The details of one or more embodiments are set forth in the accompanying drawings and the description below. Other features, objects, and advantages will be apparent from the description and drawings, and from the claims.

DETAILED DESCRIPTION

Figure 1:
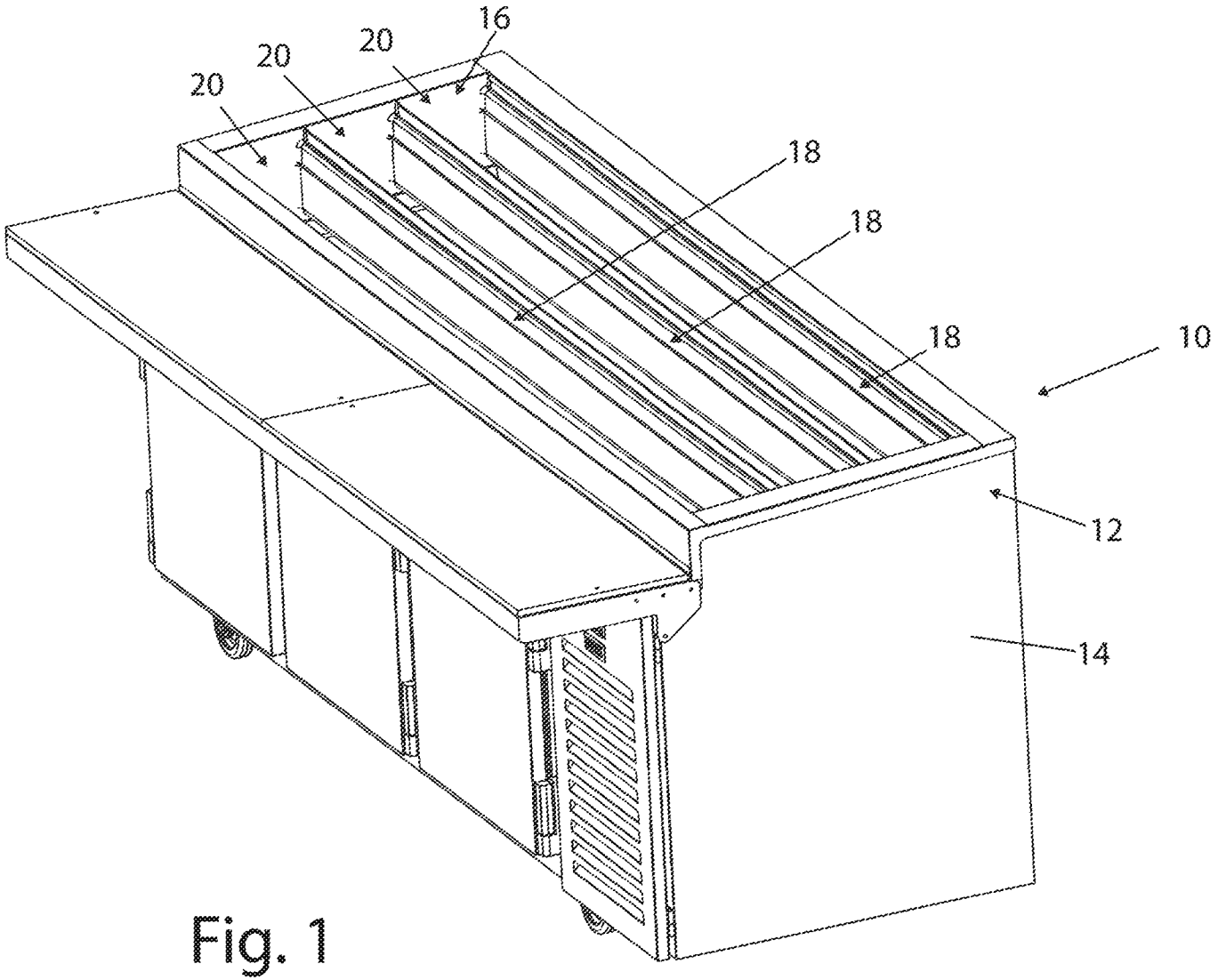
FIG. 1 shows a perspective view of a pan chiller unit.

Referring to FIGS. 1-7, a pan chiller system 10 includes a pan chiller unit 12 having a housing 14 (e.g., internal frame system and outer stainless skins) and a food well 16 within the outer housing. A plurality of hollow divider rails 18 arranged within the food well to define multiple openings 20 (here three elongated openings) to receive one or more food pans 50 to be cooled. The divider rails 18 include multiple upper rails 18A defining an upper rail flow path 30 and multiple rails 18B defining a lower rail flow path 32. A chilled liquid coolant system 22 (e.g., including suction line 22A, compressor 22B, condenser 22C, solenoid valve 22D and expansion valve 22E) chills liquid coolant (e.g., glycol) and moves chilled liquid coolant to both the upper rail flow path and the lower rail flow path (e.g., via operation of pump 24). A heat exchanger 22F may be provided to set the temperature of the chilled coolant to a desired level (e.g., 20° F. or some other temperature below freezing).

As shown, the lower rail flow path 32 path runs in parallel with the upper rail flow path 30, with the two paths operatively connected to receive chilled liquid coolant from a common feed path 40. The upper divider rails 18A are connected in series with each and include a chilled liquid coolant input 19 to the path and a chilled liquid coolant output 21 back to the system pump. The lower divider rails 18B connected in series with each other and include a chilled liquid coolant input 23 to the path and a chilled liquid coolant output 25.

Figure 6:
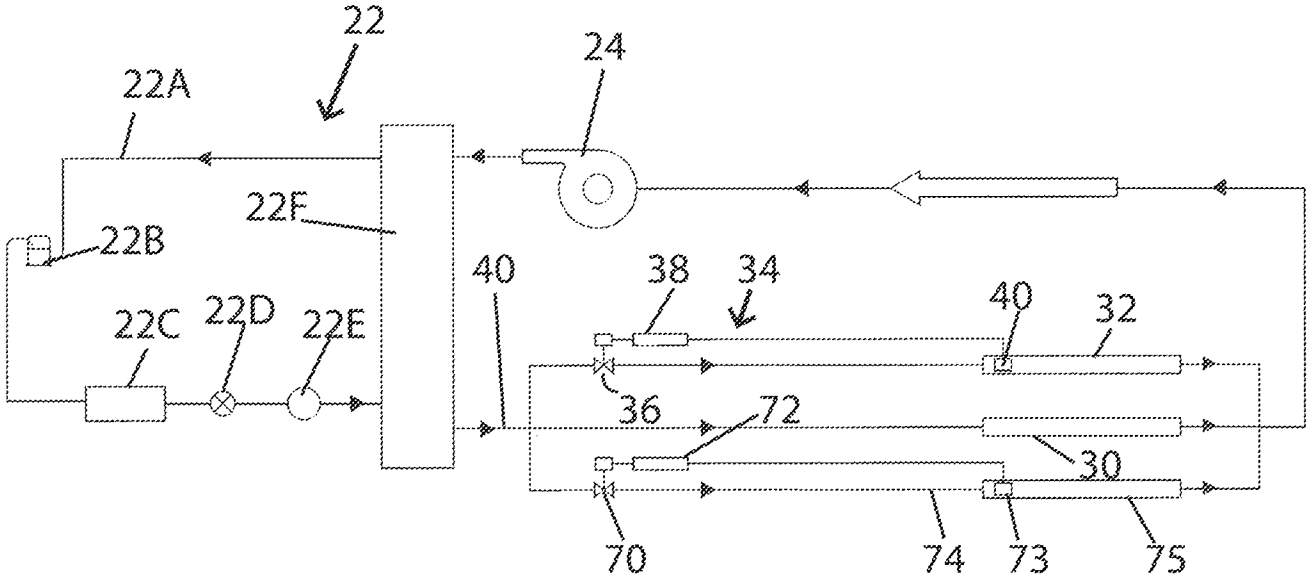
FIG. 6 shows one embodiment of a glycol chilling system and flow control arrangement.

A flow control arrangement 34 is configured for controlling flow along the lower rail flow path 32 such that a temperature condition maintained in the upper rail flow path is different than a temperature condition maintained in the lower rail flow path. In the embodiment of FIG. 6, glycol is chilled to a set temperature (e.g., 20° F.) coming from feed path 40 and flows freely through the upper rail path 30 so as to maintain the upper path substantially at the set temperature, but flow through the lower rail path 32 is selectively controlled by a valve 36 and temperature control (such as an ETC) 38 with associated temperature sensor 40 so that the lower rail flow path 32 is maintained at a temperature higher than the set temperature (e.g., in a vicinity of 30° F., a difference of about 10 degrees from the upper rail flow path), but other temperature condition variations are possible as between the two flow paths (e.g., such as a difference of about five degrees or more, or a difference as small as three degrees or even one degree).

Figure 2:
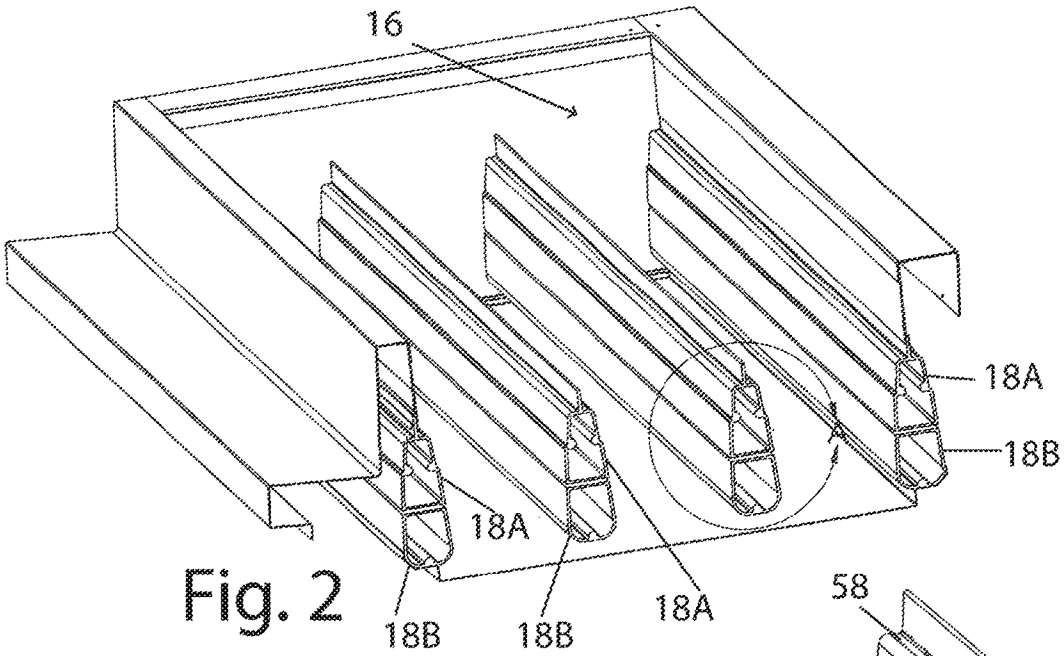
FIG. 2 shows a partial perspective of the food well of the pan chiller.
Figure 4:
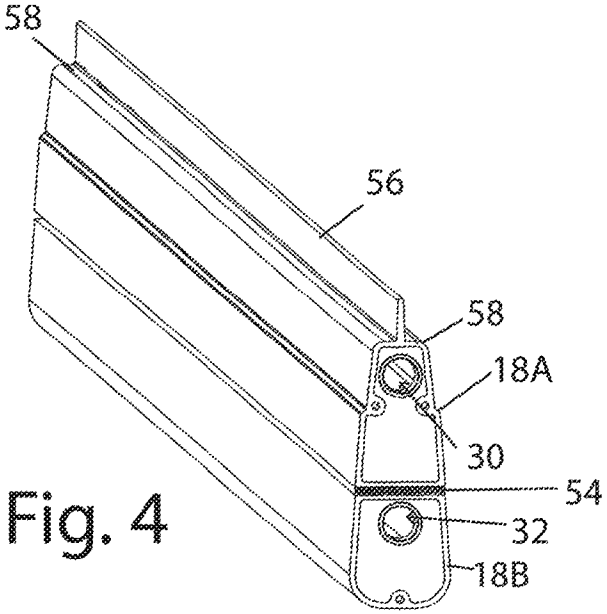
FIG. 4 shows a portion of the rail system in isolation.
Figure 3:
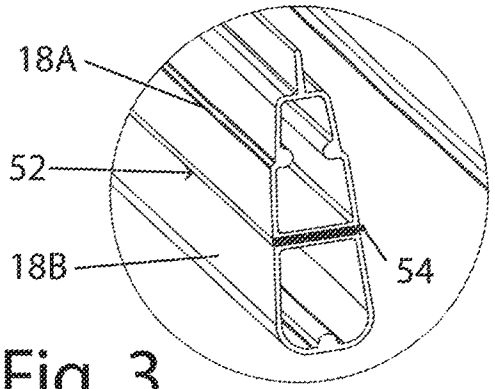
FIG. 3 shows an enlarged view of a portion of the rail system of the pan chiller.
Figure 5:
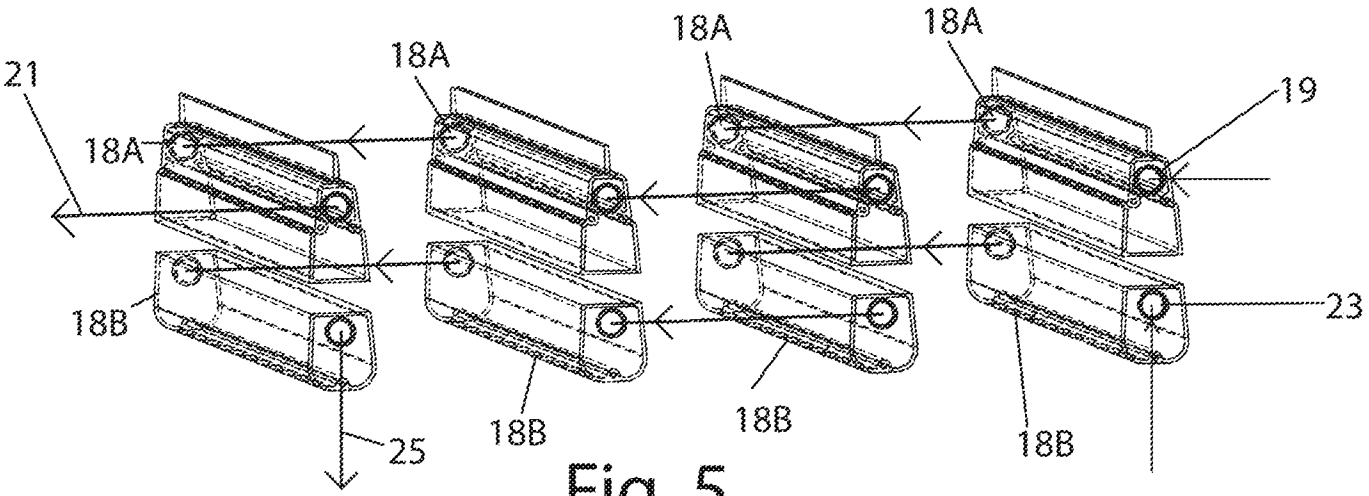
FIG. 5 depicts the flow arrangement as between the various rails of the rail system.
Figure 7:
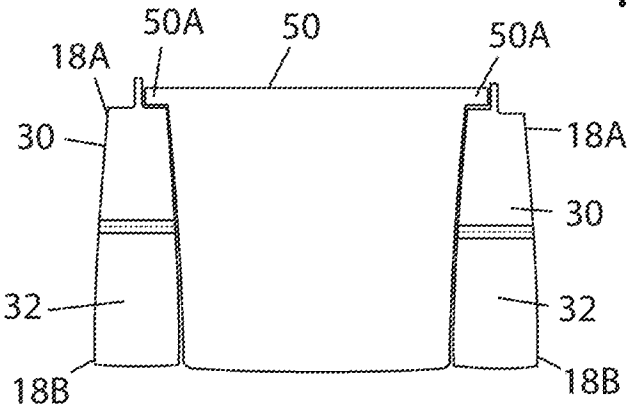
FIG. 7 shows a pan engaging the rail system.

The upper rail flow path runs along an upper portion of the openings 20 and the lower rail flow path runs along a lower portion of the openings 20, where the upper portion of the openings need not be at the very top of the openings, as seen in FIG. 2. When a pan 50 is supported in an opening, an upper sidewall portion of the pan is in heat-exchange contact with the upper rail flow path (via contact with the sides of the upper divider rails 18A) for cooling, and a lower sidewall portion of the pan 50 is in heat-exchange contact with the lower rail flow path (via contact with the sides of the lower divider rails 18B) for cooling. A space 52 may be provided between bottoms of the rails 18A of the upper rail flow path and tops of the multiple rails 18B of the lower rail flow path and, in some cases, an insulation material 54 is provided in at least part of the space in order to aid in maintaining different temperature conditions in the upper rail flow path and the lower rail flow path.

In the illustrated embodiment, the multiple rails 18A of the upper rail flow path include an upwardly extending fin 56, while none of the multiple rails 18B of the lower rail flow path include any upwardly extending fin. Shoulders 58 on both sides of the fin 56 support the pans 50 via lips 50A on the pans.

The system may include a similar valve 70 and temperature control 72 and temperature sensor 73 to deliver chilled liquid coolant along a third parallel path 74 to maintain a food cabinet 75 of the pan chiller at the same or higher temperature condition than either rail path (e.g., at a temperature suitable for refrigeration (e.g., higher than 32° F., such as 35° F.) rather than freezing).

Figure 8:
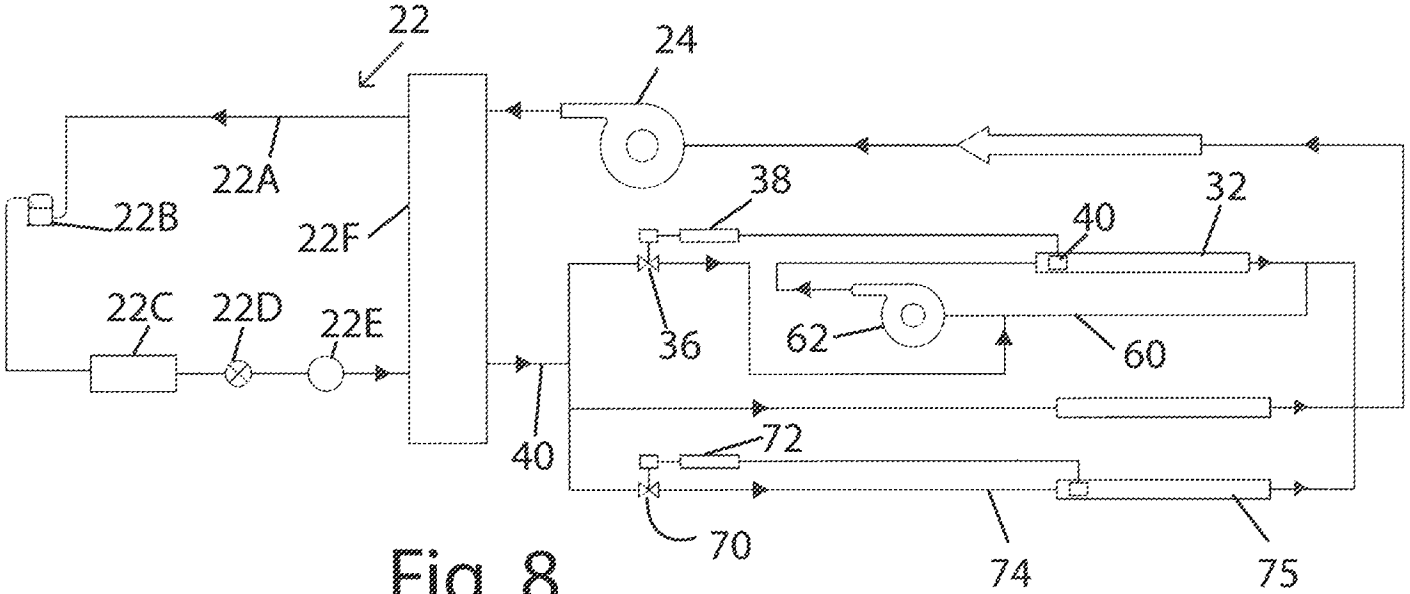
FIG. 8 shows another embodiment of a glycol chilling system and flow control arrangement.

In an alternative embodiment shown in FIG. 8, the lower rail flow path includes an associated recirculation path 60, where a secondary pump 62 is used to move liquid along the recirculation path 60 to promote better temperature consistency along the lower rail flow path, particularly during times when the lower rail flow path is not receiving a flow of chilled liquid coolant from the coolant system (e.g., when valve 36 is closed).

Figure 9:
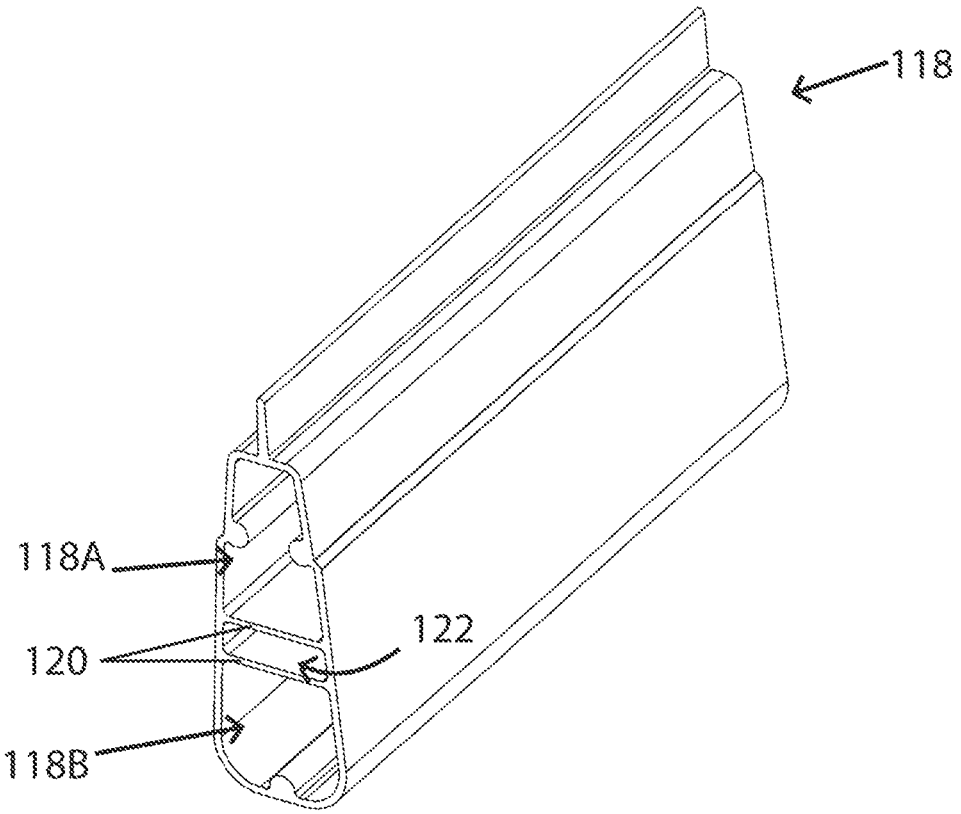
FIG. 9 shows an embodiment of a common rail that defines separate upper and lower flow paths.

While separate upper rails 18A and lower rails 18B (e.g., both of aluminum extrusion or other form) are primarily described above, it is recognized that the upper rail flow path and lower rail flow path could be formed by a set of common divider rails such as common rail 118 shown in FIG. 9. The common rail, which may be a single aluminum extrusion form, includes an upper path portion 118A and a lower path portion 118B separated by at least one internal rail wall 120. Here, two vertically spaced apart separation walls 120 are provided to create a tubular gap 122 between the paths 118A and 118B. In use, coolant does not flow along the gap 122, so the gap acts to insulate the two paths 118A and 118B from each other. The gap could include air or some other gaseous fluid therein, or could be filled with an insulating material such as foam.

Moreover, while the use of an ETC is specifically mentioned above, other forms of temperature control could be used. For example, a controller of the pan chiller could include sufficient inputs to receive multiple temperature sensor inputs and responsively control the various chilled liquid coolant system and valves and pumps. As used herein, the term controller is intended to broadly encompass any circuit (e.g., solid state, application specific integrated circuit (ASIC), an electronic circuit, a combinational logic circuit, a field programmable gate array (FPGA)), processor (e.g., shared, dedicated, or group—including hardware or software that executes code) or other component, or a combination of some or all of the above, that carries out the control functions of the machine or the control functions of any component thereof. As used herein, the term temperature control is intended to encompass any controller that is configured to be responsive to a temperature condition.

Figure 10:
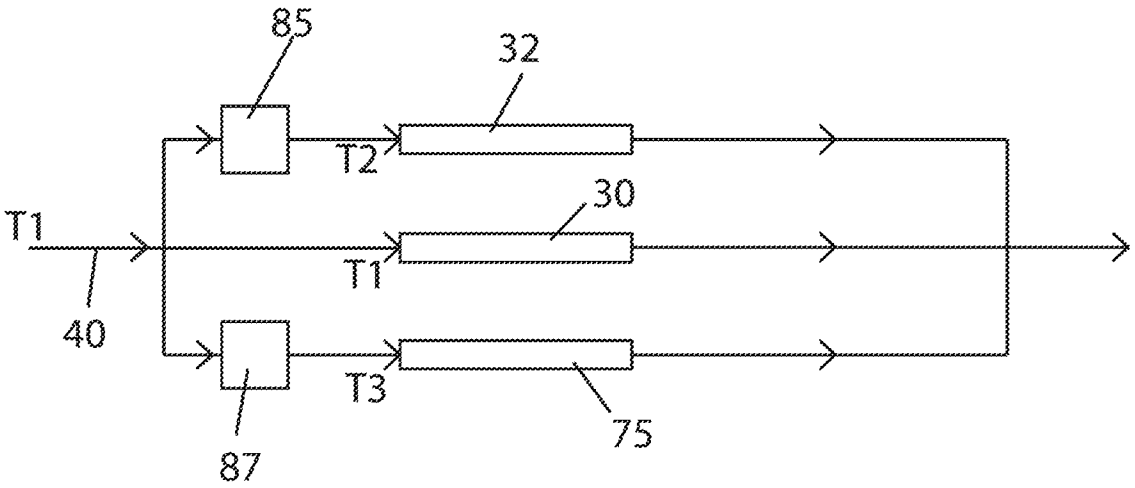
FIG. 10 shows a partial embodiment of a glycol chilling system and flow control arrangement that utilizes one or more heat exchanges to achieve the different temperatures in the upper and lower rail flow paths.

Variations in which a heat exchanger is used to bring up the temperature of the glycol delivered into the lower rail flow path (either with or without the valved control through the lower rail flow path) are also possible. FIG. 10 depicts such an exemplary arrangement, in which a heat exchanger 85 bring the temperature of the glycol up (e.g., to temperature T2) for delivery to the lower rail flow path 32, and a heat exchanger 87 brings the temperature of the glycol up for delivery to the cabinet 75, while upper rail flow path 30 receives the glycol directly from the common feed path 40 (without passing through a similar heat exchanger, so that upper rail flow path 30 receives the glycol at the set temperature of the glycol provided within the path 40).

All of the foregoing embodiments provide an advantageous method for cooling food within food pans. In particular, such method involves: providing an upper rail flow path along a food pan well and in heat exchange relationship with upper portions of multiple food pans; providing a second rail flow path along the food pan well and in heat exchange relationship with lower portions of the multiple food pans; utilizing a chilled a chilled liquid coolant system to chill a liquid coolant to a set temperature; delivering the liquid coolant to the upper rail flow path such that a first temperature condition is maintained along the upper rail flow path; and delivering the liquid coolant to the lower rail flow path such that a second temperature condition is maintained along the lower rail flow path, wherein the second temperature condition is a higher temperature condition than the first temperature condition.

It is to be clearly understood that the above description is intended by way of illustration and example only, is not intended to be taken by way of limitation, and that other changes and modifications are possible.

The invention claimed is:

1. A pan chiller system, comprising:

a pan chiller having an outer housing and a food well within the outer housing;

a plurality of hollow divider rails arranged within the food well to define at least one food pan opening, the plurality of divider rails defining a first rail flow path and a second rail flow path;

a chilled liquid coolant system for chilling liquid coolant and for moving chilled liquid coolant to both the first rail flow path and the second rail flow path; and a flow control arrangement configured for controlling flow along at least one of the first rail flow path or the second rail flow path such that a first temperature condition is maintained in the first rail flow path and a second temperature condition is maintained in the second rail flow path, wherein the first temperature condition is different than the second temperature condition;

wherein:

the first rail flow path is an upper rail flow path, the second rail flow path is a lower rail flow path, and the first temperature condition maintained in the first rail flow path is lower than the second temperature condition maintained in the second rail flow path;

the upper rail flow path runs along an upper portion of the food pan opening and the lower rail flow path runs along a lower portion of the food pan opening;

a food pan is supported in the food pan opening, wherein an upper sidewall portion of the food pan is in heat-exchange contact with the upper rail flow path for cooling via the first temperature condition, and a lower sidewall portion of the food pan is in heat-exchange contact with the lower rail flow path for cooling via the second temperature condition.

2. The pan chiller system of claim 1 wherein:

the first temperature condition is at least one degree lower than the second temperature condition.

3. The pan chiller system of claim 1 wherein:

the upper rail flow path and lower rail flow path are formed by multiple common rails, each common rail including an upper flow path portion and a lower flow path portion separated by a tubular gap, wherein the tubular gap is filled with air and/or an insulation material.

4. The pan chiller system of claim 1 wherein:

the upper rail flow path is formed by a first set of rails and the lower rail flow path is formed by a second set of rails that are spaced from the first set of rails, where a space is provided between bottoms of the first set of rails and tops of the second set of rails.

5. The pan chiller system of claim 4 wherein:

an insulation material is provided in at least part of the space in order to aid in maintaining different temperature conditions in the upper rail flow path and the lower rail flow path.

6. The pan chiller system of claim 4 wherein:

at least one of the first set of rails includes an upwardly extending fin, and none of the second set of rails include any upwardly extending fin.

7. The pan chiller of claim 1 wherein the second rail flow path is in parallel with the first rail flow path, and the second rail flow path and the first rail flow path are operatively connected to receive chilled liquid coolant from a common feed path.

8. The pan chiller system of claim 7 wherein:

the flow control arrangement includes:

a controllable valve positioned for controlling flow from the feed path through the second rail flow path;

a temperature control to detect temperature in the second rail flow path and responsively control the valve in order to achieve the second temperature condition.

9. The pan chiller system of claim 8 wherein:

chilled liquid coolant flows freely from the feed path and through the first rail flow path.

10. The pan chiller system of claim 8 wherein:

the second rail flow path includes an associated recirculation path, the flow control arrangement includes a pump for moving liquid along the recirculation path to promote temperature consistency along the second rail flow path.

11. A pan chiller system comprising:

a pan chiller unit having a food well;

a plurality of hollow divider rails arranged within the food well to define at least one food pan opening, the plurality of divider rails defining a first rail flow path and a second rail flow path;

a chilled liquid coolant system for chilling liquid coolant and for moving chilled liquid coolant into both the first rail flow path and the second rail flow path;

a control arrangement configured for controlling chilled liquid coolant flow such that a first temperature condition is maintained in the first rail flow path and a second temperature condition is maintained in the second rail flow path, wherein the first temperature condition is different than a second temperature condition;

wherein:

the first rail flow path is an upper rail flow path, the second rail flow path is a lower rail flow path, and the first temperature condition maintained in the first rail flow path is lower than the second temperature condition maintained in the second rail flow path;

the upper rail flow path runs along an upper portion of the food pan opening and the lower rail flow path runs along a lower portion of the food pan opening;

a food pan is supported in the food pan opening, wherein an upper sidewall portion of the food pan is in heat-exchange contact with the upper rail flow path for cooling a food within the pan via the first temperature condition, and a lower sidewall portion of the food pan is in heat-exchange contact with the lower rail flow path for cooling the food within the pan via the second temperature condition.

12. The pan chiller system of claim 11 wherein:

the control arrangement includes:

a common feed path providing chilled liquid coolant at a set temperature;

a heat exchanger that receives chilled liquid coolant from the common feed path and increases a temperature of the chilled liquid coolant before the chilled liquid coolant is delivered to the second rail flow path, wherein chilled liquid coolant is delivered from the common feed path to the first rail flow path at the set temperature.

13. The pan chiller system of claim 11 wherein:

the control arrangement includes:

a controllable valve positioned for controlling flow through the second rail flow path;

a temperature control to detect temperature in the second rail flow path and responsively control the valve in order to achieve the second temperature condition;

wherein chilled liquid coolant flows freely through the first rail flow path.

14. The pan chiller system of claim 13 wherein:

the second rail flow path includes a recirculation path, the control arrangement includes a pump for moving liquid along the recirculation path to promote temperature consistency along the second rail flow path.

* * * * *